US008382914B2

(12) United States Patent
Jerg

(10) Patent No.: US 8,382,914 B2
(45) Date of Patent: Feb. 26, 2013

(54) DISHWASHER WITH COMMINUTION DEVICE

(75) Inventor: Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1983 days.

(21) Appl. No.: 10/573,457

(22) PCT Filed: Oct. 8, 2004

(86) PCT No.: PCT/EP2004/011271

§ 371 (c)(1),
(2), (4) Date: Mar. 24, 2006

(87) PCT Pub. No.: WO2005/034714

PCT Pub. Date: Apr. 21, 2005

(65) Prior Publication Data

US 2007/0107753 A1 May 17, 2007

(30) Foreign Application Priority Data

Oct. 8, 2003 (DE) ..... 103 46 675

(51) Int. Cl.
*A47L 15/42* (2006.01)

(52) U.S. Cl. ..... 134/115 G; 134/56 D; 134/104.4

(58) Field of Classification Search ..... 134/115 G
See application file for complete search history.

(56) References Cited

U.S. PATENT DOCUMENTS

| | | | |
|---|---|---|---|
| 2,918,811 | A | 12/1959 | Schele |
| 3,981,456 | A | 9/1976 | Hahn et al. |
| 6,471,467 | B1 | 10/2002 | Pagalday |

FOREIGN PATENT DOCUMENTS

| | | | |
|---|---|---|---|
| DE | 42 44 365 | | 7/1993 |
| DE | 44 24 257 | | 1/1996 |
| DE | 296 13 432 | | 9/1996 |
| EP | 0 079 752 | | 5/1983 |
| EP | 1 057 445 | | 12/2000 |
| EP | 1057445 | A2 * | 12/2000 |
| EP | 1 256 306 | | 11/2002 |

OTHER PUBLICATIONS

International Search Report PCT/EP2004/011271.

* cited by examiner

*Primary Examiner* — Michael Barr
*Assistant Examiner* — Jason Riggleman
(74) *Attorney, Agent, or Firm* — James E. Howard; Andre Pallapies

(57) ABSTRACT

A dishwasher is provided with a washing container for receiving items to be washed by the dishwasher, a circulatory pump for circulating a rinsing liquid into contact with items received in the washing container, and a comminution device for comminuting rinsing residue. The comminution device and the circulatory pump are operatively interconnected in a manner such that the comminution device is at least temporarily driven by the circulatory pump. As a result, the comminution device can be driven in a simple and efficient manner, enabling the dishwasher to be produced at low cost and also increasing the reliable operability and easy maintenance thereof.

8 Claims, 2 Drawing Sheets

DISHWASHER WITH COMMINUTION DEVICE

The invention relates to a dishwasher with a device for comminuting rinsing residue.

BACKGROUND OF THE INVENTION

When items to be washed in a dishwasher are cleaned, rinsing residue usually occurs and collects at the bottom of the dishwasher. Some of the rinsing residue is frequently too coarse or too heavy so that it cannot be removed from the dishwasher after the rinsing process together with the used rinsing solution via the discharge pump. Consequently, coarse rinsing residue becomes deposited in the transport paths of the rinsing liquid or blocks the sieves provided in the dishwasher which can severely impair the operation of the dishwasher.

Sieve devices which can be removed from the dishwasher, cleaned and re-inserted are already known to eliminate this problem. These sieve devices have the disadvantage that the cleaning process is unpleasant for the user. Furthermore, the cleaning process is frequently forgotten or carried out too infrequently so that problem-free operation of the dishwasher is no longer ensured as a result of blockage of the sieve devices and obstruction in the transport paths of the rinsing liquid which disadvantageously affect the rinsing result and in extreme cases, can result in damage to the dishwasher.

In further known dishwashers a comminution device (shredder) is provided which can be used to comminute rinsing residue accumulating during the rinsing process in the dishwasher so that it can be removed from the dishwasher in the comminuted state together with the used rinsing solution via the discharge pump. However, the known comminution devices have the disadvantage that they must be driven by means of their own motor. Since the motors are one of the most costly components in a dishwasher, they constitute a large proportion of the total manufacturing costs of a dishwasher. Each additional motor consequently increases the manufacturing costs of a dishwasher and also the risk of a breakdown.

SUMMARY OF THE INVENTION

It is thus the object of the present invention to provide a dishwasher with a comminution device, which can be produced at low cost, and enables large contaminant particles occurring during operation of said dishwasher to be comminuted in a simple manner inside the dishwasher, to be removed from the dishwasher and to improve the performance of the dishwasher whilst at the same time improving the easy maintenance of the said dishwasher.

This object is solved by the dishwasher according to the invention having the features described herein.

Provided in the dishwasher according to the invention is a circulatory pump for circulating the rinsing liquid and a comminution device for comminuting rinsing residue, where the comminution device is at least temporarily driven by the circulatory pump.

The dishwasher with a comminution device according to the present invention has the advantage that the comminution device is driven simply and efficiently which enables the dishwasher to be manufactured inexpensively and also improves the operating safety of the dishwasher. The comminution device for example is equipped with a plurality of comminuting blades which comminute the coarse contaminants at high speeds. The coarse contaminants occurring in the dishwasher during washing are thereby comminuted so that they can be removed from the dishwasher together with the used rinsing liquid which improves the rinsing result and also enhances the ease of maintenance of the dishwasher.

In the dishwasher according to the invention, the comminution device can be operated only temporarily, i.e. it can be specifically switched on and off as required. The comminution device can then be only activated for example when coarse rinsing residue occurs in the dishwasher, such as for example during the pre-rinse phase or during the washing process. The temporary operation of the comminution device has the advantage that the comminution device can be only driven as required whereby, on the one hand, the energy consumption for driving the comminution device can be kept as low as possible and on the other hand, the comminution device itself is protected.

In an advantageous embodiment of the dishwasher with a comminution device according to the present invention, the drive coupling between the comminution device and the circulatory pump is made by means of a safety-friction clutch wherein the driving force is transmitted by mutual friction of the two coupling components. As a result, the comminution device can be switched on and off as required during the washing operation without interrupting the operation of the circulatory pump. The safety friction clutch prevents the comminution device or items of cutlery from being damaged if the comminution device becomes blocked for example by the comminuting blades becoming entangled with non-comminutable items or items of cutlery which have dropped down.

At the same time, it is particularly advantageous if the comminution device is driven by means of the impeller of the circulatory pump. The impeller of the circulatory pump circulates the rinsing liquid in the dishwasher, i.e. pumps it into the transport paths provided therefor. Consequently, the impeller is also one of the components of the circulating pump which rotates at the highest speeds. Since the comminution device is preferably also operated at high speeds to achieve a good comminution effect, the impeller of the circulatory pump is especially suitable for driving the comminution device without the need to provide a gearbox therebetween.

The temporary drive of the comminution device can be achieved particularly simply if the drive coupling between the comminution device and the circulatory pump is made by means of a connecting shaft. In this case, the connecting shaft is preferably axially displaceable and its axial freedom of movement is limited by stops, wherein in one stop position of the connecting shaft the drive coupling between the comminution device and the circulatory pump is made and in the other stop position of the connecting shaft, the drive coupling between the comminution device and the circulatory pump is broken. In this way, the drive coupling between the comminution device and the circulatory pump can be made or broken as desired merely by an axial displacement of the connecting shaft between the comminution device and the circulatory pump.

More appropriately, the connecting shaft between the comminution device and the circulatory pump can be coupled to the hub of the impeller of the circulatory pump, wherein the connecting shaft has at least one free end in the direction of the circulating pump. As a result of the axial displacement of the connecting shaft between the comminution device and the circulatory pump in the direction of the circulatory pump, the free end of the connecting shaft can be brought close to the hub of the impeller of the circulatory pump and brought into contact therewith until the connecting shaft and the impeller of the circulatory pump are coupled to one another. As mentioned above, the free end of the connecting shaft and the hub of the impeller of the circulatory pump are preferably configured so that they form a safety-friction clutch where the drive force is transmitted by mutual friction between the connecting shaft and the impeller of the circulatory pump. Alternatively, the free end of the connecting shaft and the hub of the impeller of the circulatory pump can be shaped in such a complementary fashion to one another that they can intermesh without the possibility of a difference in the speed.

In order that the drive coupling between the comminution device and the circulatory pump can be specifically switched on or off, there is preferably provided a coupling regulator by which means the drive coupling can be made or broken. The coupling regulator can especially comprise a combination of a positive temperature coefficient (PCT) and an actuating element consisting of a shape memory alloy (FGL) which acts mechanically on the drive coupling between the comminution device and the circulatory pump and thereby switches it on or off.

The actuating element made of a shape memory alloy has the property of acquiring predefined shapes at certain temperatures whereas the positive temperature coefficient can be heated electrically, is in heat-conducting contact with the actuating element made of a shape memory alloy and thus heats it. For the use according to the present invention, the actuating element made of a shape memory alloy is adjusted, for example, so that at a first temperature it acquires a first predefined shape whereby the drive coupling between the comminution device and the circulatory pump is broken and at a second temperature, acquires a second predefined shape whereby the drive coupling between the comminution device and the circulatory pump is made. With the aid of the positive temperature coefficient, the actuating element made of a shape memory alloy can be brought to the first or second temperature, immediately acquiring the corresponding first or second shape and thereby switching on or off the drive coupling between the comminution device and the circulatory pump. The activation or deactivation of the combination of a positive temperature coefficient and an actuating element made of a shape memory alloy is preferably made by an electronic control of the dishwasher.

In a further advantageous embodiment of the present invention, there is provided at the connecting shaft between the comminution device and the circulatory pump at least two radial projections between which an actuating element of the coupling regulator engages. The two radial projections at the connecting shaft create a friction bearing for the actuating element of the coupling regulator by which means the connecting shaft can be exposed to force in both axial directions to effect the axial displacement of the connecting shaft or hold the connecting shaft in a desired axial position.

Alternatively, the drive coupling between the comminution device and the circulatory pump can also be made or broken by an electromagnetic switch which effects the axial displacement of the connecting shaft between the comminution device and the circulatory pump by action of electromagnetic force. The electromagnetic switch operates on the principle of a coil through which an electric current flows and which surrounds a ferrite core, wherein the connecting axis between the comminution device and the circulatory pump represents the ferrite core. The coil of the electromagnetic switch at least partly surrounds the connecting axis so that it exerts a force on the connecting axis in the axial direction as soon as electric current flows through the coil. When an electric current flows through the coil in a first polarity, the coil produces an axial force on the connecting axis in a first direction and when an electric current flows through the coil in a polarity opposite to the first polarity, the coil produces an axial force on the connecting axis in a direction opposite to said first direction. In this way, the connecting shaft between the comminution device and the circulatory pump can be exposed to force in both axial directions as desired to effect the axial displacement of the connecting shaft or hold the connecting shaft in a desired axial stop position.

It is particularly advantageous if the comminution device is disposed inside and the coupling regulator is disposed outside the washing container of the dishwasher. Such an arrangement has the advantage that the positive temperature coefficient (PTC) controlling the actuating element consisting of a shape memory alloy (FGL) or the coil of the electromagnetic switch is located outside the washing container and is therefore protected from the fluctuating temperatures of the rinsing liquid. Contact between the power supply of the positive temperature coefficient or the coil of the electromagnetic switch and the rinsing liquid is further prevented, thus ensuring the operating safety of the dishwasher according to the invention.

BRIEF DESCRIPTION OF THE DRAWINGS

The present invention is explained in detail hereinafter using an exemplary embodiment with reference to the drawings. In the figures.

DETAILED DESCRIPTION OF THE EXEMPLARY EMBODIMENTS OF THE PRESENT INVENTION

Figure 1:
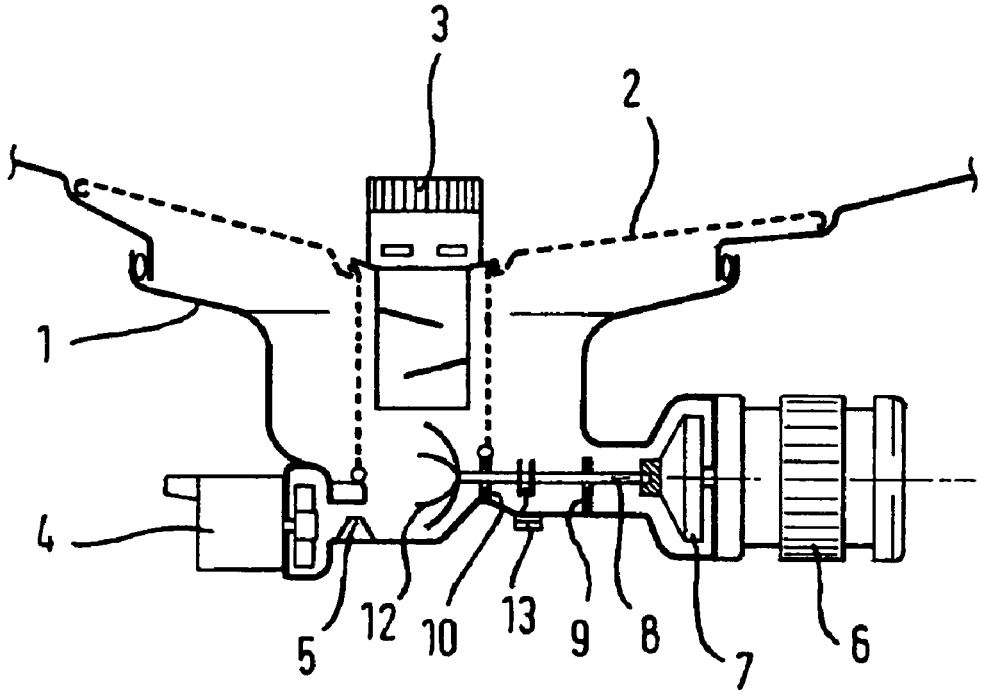
FIG. 1 is a cross-section of the lower part of a dishwasher with a comminution device according to the present invention.

FIG. 1 shows a cross-section of the lower part of a dishwasher with a comminution device according to the present invention. Located in the lower part of the dishwasher is the sump 1 which closes the washing container (not shown in full) of the dishwasher. Provided in the upper part of the sump 1 is a sieve arrangement 2 and 3, substantially consisting of a fine sieve 2 and a coarse sieve 3 located therein. During the rinsing operation, the rinsing liquid flows downwards in the washing container through the sieve arrangement 2 and 3 and collects at the bottom of the sump 1. From there the rinsing liquid is either pumped by the circulating pump 6 back into the transport paths for the rinsing liquid during rinsing operation or during pumping-out it is removed from the dishwasher by the discharge pump 4 though a trap 5.

Especially during the pre-rinse phase and the cleaning process, coarse rinsing residue which has fallen through the coarse sieve 3 accumulates in an area before the trap 5 at the lowest part of the sump 1 and when the used rinsing liquid is pumped away, this cannot be removed from the dishwasher through the trap 5 by means of the discharge pump 4. Located in this area are comminuting blades 12 of a comminution device which can be set in rotary motion at high speeds to comminute the coarse contaminants which have accumulated. In comminuted form, the rinsing residue can then be removed through the trap 5 by means of the discharge pump 4 when the used rinsing liquid is removed from the dishwasher.

The comminution device substantially consists of a connecting axle 8 which can be rotated by means of two bearings 9 and 10 at the bottom of the sump 1 and is mounted so that it is displaceable in the axial direction. The connecting axle 8 has two free ends, one free end being equipped with the comminuting blades 12 which comminute the coarse contaminants at the bottom of the sump 1 when the comminution device is operating. The other free end 18 of the connecting axle 8 is coupled to the impeller 7 of the circulatory pump 6. During operation of the dishwasher the impeller 7 is driven by the circulatory pump 6 and is thereby brought into rotation at high speeds whereby, as a result of the direct coupling of the impeller 7 with the connecting axle 8 of the comminution device, the comminuting blades 12 are set in the same rotation at high speeds.

Figure 2:
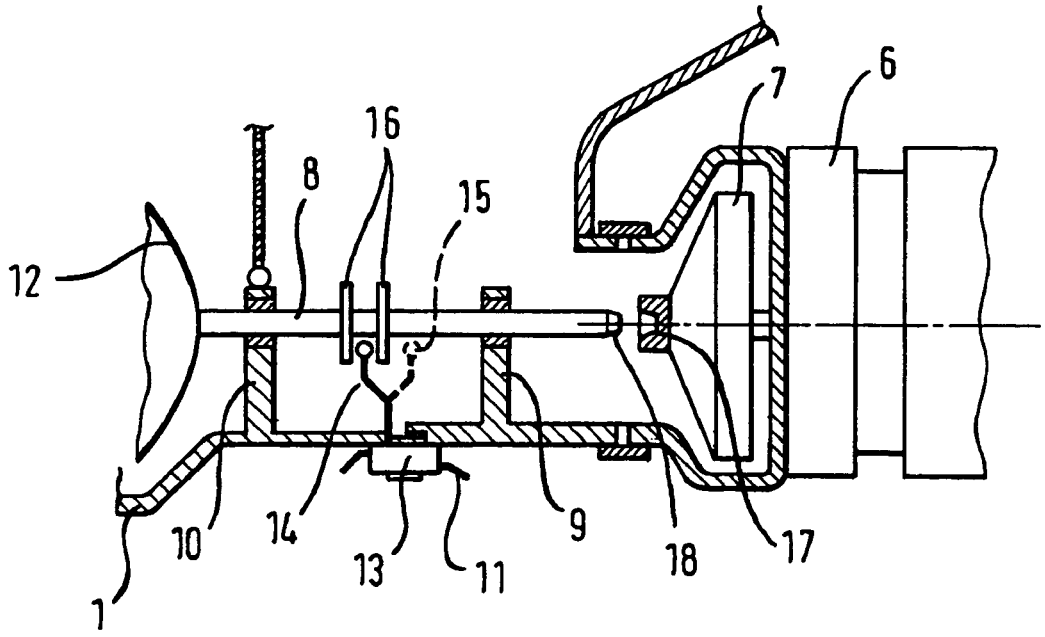
FIG. 2 is a detailed view of the cross-section of the lower part of a dishwasher with a comminution device according to the present invention shown in FIG. 1.

FIG. 2 shows a detailed view of the cross-section of the lower part of the dishwasher with the comminution device according to the present invention shown in FIG. 1. It can be seen from FIG. 2 that the comminution device substantially has a connecting axle 8 which can be rotated through two bearings 9 and 10 at the bottom of the sump 1 and is mounted so that it is displaceable in the axial direction. In FIG. 2 the connecting axle 8 is shown in a position shifted axially to the left in which the free end 18 of the connecting axle 8 opposite to the comminuting blades 12 is at a distance from the impeller 7 of the circulatory pump 6 and is thus decoupled.

Provided on the connecting shaft 8 between the two mountings 9 and 10 are two radial projections in the form of disks between which the actuating element 14 of a coupling regulator 13 engages. The two radial disks on the connecting shaft 8 thus form a friction bearing 16 by which means the connecting shaft 8 can be exposed to force in both axial directions from the actuating element 14 of the coupling regulator 13 to effect the axial displacement of the connecting shaft 8 or hold the connecting shaft 8 in a desired axial position.

The coupling regulator 13 comprises a positive temperature coefficient (PTC) element which is in heat-conducting contact with the actuating element 14. The actuating element 14 consists of a shape memory alloy (FGL) which has the property of acquiring predefined shapes at specific temperatures. In the exemplary embodiment shown in the drawings, the shape memory alloy of the actuating element 14 is adjusted so that at a first temperature it acquires a first predefined shape and thereby axially displaces the connecting axle 8 to the left by means of the friction bearing 16 into a position wherein the drive coupling between the connection axle 8 and the impeller 7 of the circulatory pump 6 is broken and at a second temperature acquires a second predefined shape 15 and thereby displaces the connecting axle 8 axially to the right by means of the friction bearing 16 into a position wherein the drive coupling between the connecting axle 8 and the impeller 7 of the circulatory pump 6 is made.

The positive temperature coefficient element of the coupling regulator 13 can be electrically heated in order to heat the shape memory alloy of the actuating element 14 to the desired temperature by means of heat-conducting contact. Using the positive temperature coefficient element 13 the actuating element 14 can thus be brought to the first or second temperature, immediately acquiring the corresponding first 14 or second shape 15 and thereby switching on or off the drive coupling between the connecting axle 8 of the comminution device and the impeller 7 of the circulatory pump 6.

The coupling regulator 13 is activated or deactivated by means of electrical connections 11 which are connected to an electronic control of the dishwasher. Whereas the actuating element 14 is located inside the sump 1, the coupling regulator 13 is located outside the sump 1 to protect it from influences of the rinsing liquid and prevent any contact of the rinsing liquid with the power supply 11 to the coupling regulator 13.

When the actuating element 14 is in the position 15 in which it displaces the connecting axle 8 axially to the right by means of the friction bearing 16, the free end 18 of the connecting axle 8 of the comminution device comes in contact with the hub of the impeller 7 of the circulating pump 6. In the present exemplary embodiment the drive coupling between the connecting axle 8 and the impeller 7 of the circulatory pump 6 is made via a safety-friction clutch. In this case, the free end 18 of the connecting axle 8 of the comminution device and the hub of the impeller 7 of the circulatory pump 6 is configured so that the drive force is transmitted by mutual friction of the two coupling components.

As a result of the drive coupling between the connecting axle 8 of the comminution device and the impeller 7 of the circulatory pump 6 by means of the safety-friction clutch 17, 18, the comminution device can be switched on and off as desired during rinsing operation without interrupting or hindering the operation of the circulatory pump 6. Furthermore, if a blockage occurs in the comminuting blades 12, the safety-friction clutch 17, 18 can slip without damaging the circulatory pump 6 or interrupting its operation.

REFERENCE LIST

1. Sump
2. Fine sieve
3. Coarse sieve
4. Discharge pump
5. Trap
6. Circulatory pump
7. Impeller of circulatory pump 6
8. Connecting axle of comminution device
9. Mounting of comminution device
10. Mounting of comminution device
11. Electric connections of coupling regulator 13
12. Comminuting blades of comminution device
13. Coupling regulator (positive temperature coefficient, PTC)
14. Actuating element (shape memory alloy, FGL) of coupling regulator 13
15. Second position of actuating element
16. Radial disks/friction bearings on connecting axle 8
17. Hub of impeller 7
18. Free end of connecting axle 8

The invention claimed is:

1. A dishwasher comprising:

a washing container for receiving items to be washed by the dishwasher;

a circulatory pump for circulating a rinsing liquid into contact with items received in the washing container; and a comminution device for comminuting rinsing residue, the comminution device and the circulatory pump being operatively interconnected in a manner such that the comminution device is temporarily driven by the circulatory pump, wherein the comminution device and the circulatory pump are operatively interconnected such that a drive coupling between the comminution device and the circulatory pump is made by means of a connecting shaft that is a selected one of axial displaceable and non-axially displaceable, and wherein the connecting shaft is selectively axially displaceable into engagement with the circulatory pump such that a drive coupling between the comminution device and the circulatory pump is made by means of an axial displacement of the connecting shaft into engagement with the circulatory pump and a drive coupling between the comminution device and the circulatory pump is broken as desired by means of an axial displacement of the connecting shaft out of engagement with the circulatory pump.

2. The dishwasher according to claim 1, and further comprising a safety-friction clutch, wherein the drive coupling between the comminution device and the circulatory pump is made by means of the safety-friction clutch.

3. The dishwasher according to claim 1, wherein the comminution device and the circulatory pump are operatively interconnected such that the drive of the comminution device is effected by means of an impeller of the circulatory pump.

4. The dishwasher according to claim 1, wherein the connecting shaft between the comminution device and the circulatory pump is selectively couplable to a hub of an impeller of the circulatory pump.

5. A dishwasher comprising:

a washing container for receiving items to be washed by the dishwasher;

a circulatory pump for circulating a rinsing liquid into contact with items received in the washing container; and a comminution device for comminuting rinsing residue, the comminution device and the circulatory pump being operatively interconnected in a manner such that the comminution device is at least temporarily driven by the circulatory pump, wherein the comminution device and the circulatory pump are operatively interconnected such that a drive coupling between the comminution device and the circulatory pump is made by means of a connecting shaft that is a selected one of axial displaceable and non-axially displaceable, wherein the comminution device and the circulatory pump are operatively interconnected by means of a coupling regulator operable to selectively effect a drive coupling between the comminution device and the circulatory pump and to break a drive coupling between the comminution device and the circulatory pump, wherein the coupling regulator includes a selected one of a combination of a positive temperature coefficient and an actuating element consisting of a shape memory alloy and the absence of a combination of a positive temperature coefficient and an actuating element consisting of a shape memory alloy.

6. The dishwasher according to claim 5, wherein the coupling regulator includes an actuating element and further comprising at least two radial projections provided at the connecting shaft between the comminution device and the circulatory pump, the actuating element of the coupling regulator being located between the at least two radial projections for engaging the at least two radial projections to effect the axial displacement of the connecting shaft.

7. A dishwasher comprising:

a washing container for receiving items to be washed by the dishwasher;

a circulatory pump for circulating a rinsing liquid into contact with items received in the washing container; and a comminution device for comminuting rinsing residue, the comminution device and the circulatory pump being operatively interconnected in a manner such that the comminution device is at least temporarily driven by the circulatory pump, wherein the comminution device and the circulatory pump are operatively interconnected such that a drive coupling between the comminution device and the circulatory pump is made by means of a connecting shaft that is a selected one of axial displaceable and non-axially displaceable, wherein the drive coupling between the comminution device and the circulatory pump can be made or broken by an electromagnetic switch which effects the axial displacement of the connecting shaft between the comminution device and the circulatory pump by action of electromagnetic force.

8. The dishwasher according to claim 5, wherein the comminution device is disposed inside and the coupling regulator is disposed outside the washing container of the dishwasher.

* * * * *

UNITED STATES PATENT AND TRADEMARK OFFICE

CERTIFICATE OF CORRECTION

PATENT NO. : 8,382,914 B2
APPLICATION NO. : 10/573457
DATED : February 26, 2013
INVENTOR(S) : Helmut Jerg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1984 days.

Signed and Sealed this
First Day of September, 2015

Michelle K. Lee

Michelle K. Lee
*Director of the United States Patent and Trademark Office*